US007661981B2

(12) United States Patent
Cross et al.

(10) Patent No.: US 7,661,981 B2
(45) Date of Patent: Feb. 16, 2010

(54) TAMPER EVIDENT CONNECTOR SYSTEM

(75) Inventors: Scott Mitchell Cross, Winston-Salem, NC (US); David Allen Klein, Kernersville, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/386,540

(22) Filed: Apr. 20, 2009

(65) Prior Publication Data

US 2009/0233476 A1 Sep. 17, 2009

(51) Int. Cl.
*H01R 13/58* (2006.01)

(52) U.S. Cl. ..... 439/468; 439/902; 439/953

(58) Field of Classification Search ..... 439/468, 439/953, 301–304, 473, 471, 446, 372, 902, 439/274, 371, 373, 449, 345
See application file for complete search history.

(56) References Cited

U.S. PATENT DOCUMENTS 2,580,359 A * 12/1951 Moineau ..... 362/353
5,071,369 A * 12/1991 Denlinger et al. ..... 439/595
5,174,781 A * 12/1992 Muzslay ..... 439/372
5,310,352 A * 5/1994 Mroczkowski et al. ..... 439/76.1
5,501,606 A * 3/1996 Oda et al. ..... 439/140
5,993,255 A * 11/1999 Yurko ..... 439/595
D449,398 S * 10/2001 Tsao ..... D26/63
6,305,990 B1 * 10/2001 Ward ..... 439/752
6,739,896 B2 * 5/2004 Sivertsen ..... 439/371
7,524,215 B2 * 4/2009 Banas et al. ..... 439/731
2003/0220000 A1 * 11/2003 Ward et al. ..... 439/108

* cited by examiner

*Primary Examiner*—T C Patel
*Assistant Examiner*—Harshad C Patel

(57) ABSTRACT

An electrical assembly is disclosed that provides evidence of tampering. The assembly includes a plug housing with a seal cover attached thereto. A wire dress cover is attached over the seal cover, and a locking insert is placed through the wire dress cover and is held in place by a serialized lock-wire. The locking insert overlies a jack screw, which prevents the disconnection of the plug housing or removal of a wire cover without first removing the locking insert or lock-wire.

20 Claims, 9 Drawing Sheets

TAMPER EVIDENT CONNECTOR SYSTEM

RELATED APPLICATION

This application is related to application Ser. No. 12/077,097 filed Mar. 17, 2008, the entirety of which is incorporated herein by reference.

BACKGROUND OF THE INVENTION

The present application relates to electrical connector plug assemblies and more particularly to plug assemblies which are mateable to a device that requires evidence of tampering.

There are numerous applications, particularly in the automotive industry, whereby a plug assembly is connected to an electronic control unit (ECU) which provides I/O connections between the electronics and a drive or control system/component. These connections provide for the controls of various vehicles or equipment, which could be automobiles, other similar devices such as construction equipment, or any industrial/commercial/consumer equipment that requires tamper restrictions where an ECU controls various dynamic situations on the application. For example, the ECU may control such values as maximum rpm or maximum torque, and the like. These data points and/or settings are established by the original equipment manufacturer (OEM) in order that the maximum safe working conditions for various components are not exceeded, preventing components from being stressed beyond their designed limitations.

However, users attempt to push the limits of the working parameters or gain additional functions of the equipment and, in some cases, actually reprogram the working limits of the various components by gaining access to the electrical contacts or "un-mating" the connector and being able to remove or re-program certain electrical contacts and/or contact locations. In some cases, re-programming the computer to make more power may not damage the equipment, but instead damage a system or component that was not designed to handle the additional power or other demand placed on it. In order for the OEMs to know, for warranty purposes, whether a connector assembly and/or its associated ECU have been tampered with, it would be advantageous to provide a connector assembly which provides evidence of tampering.

These and other objects have been accomplished as provided herein.

BRIEF SUMMARY OF THE INVENTION

The objects were accomplished by providing an electrical connector assembly for attachment to a mating device, comprising a plug housing assembly; an attachment mechanism for attaching the plug housing assembly to the mating device; a wire dress cover attached to the plug housing assembly, with an access opening communicating with the attachment mechanism; and a lock-wire receivable over the access opening and covering the attachment mechanism, and being retainable to the plug housing assembly In an another embodiment an electrical connector assembly comprises a plug housing assembly; an attachment mechanism for attaching the plug housing assembly to the mating device; a wire dress cover attached to the plug housing assembly, with an access opening communicating with the attachment mechanism; an insert member at least partially covering the access opening; and an elongate tensioned member attached to the plug housing assembly and retaining the insert member over the access opening.

DETAILED DESCRIPTION OF THE DRAWINGS

Figure 1:
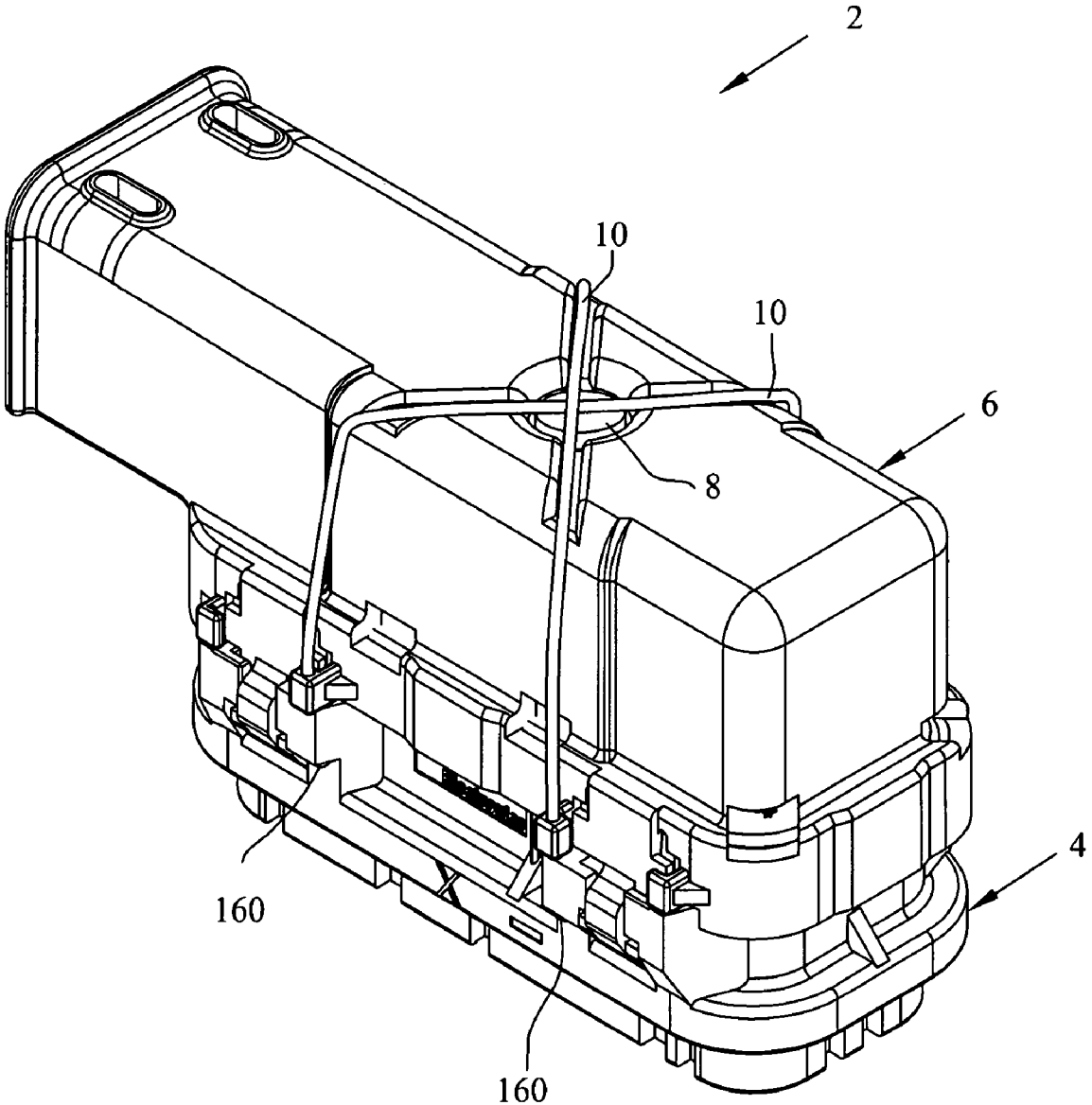
FIG. 1 shows a perspective view of the connector assembly of the present invention.
Figure 2:
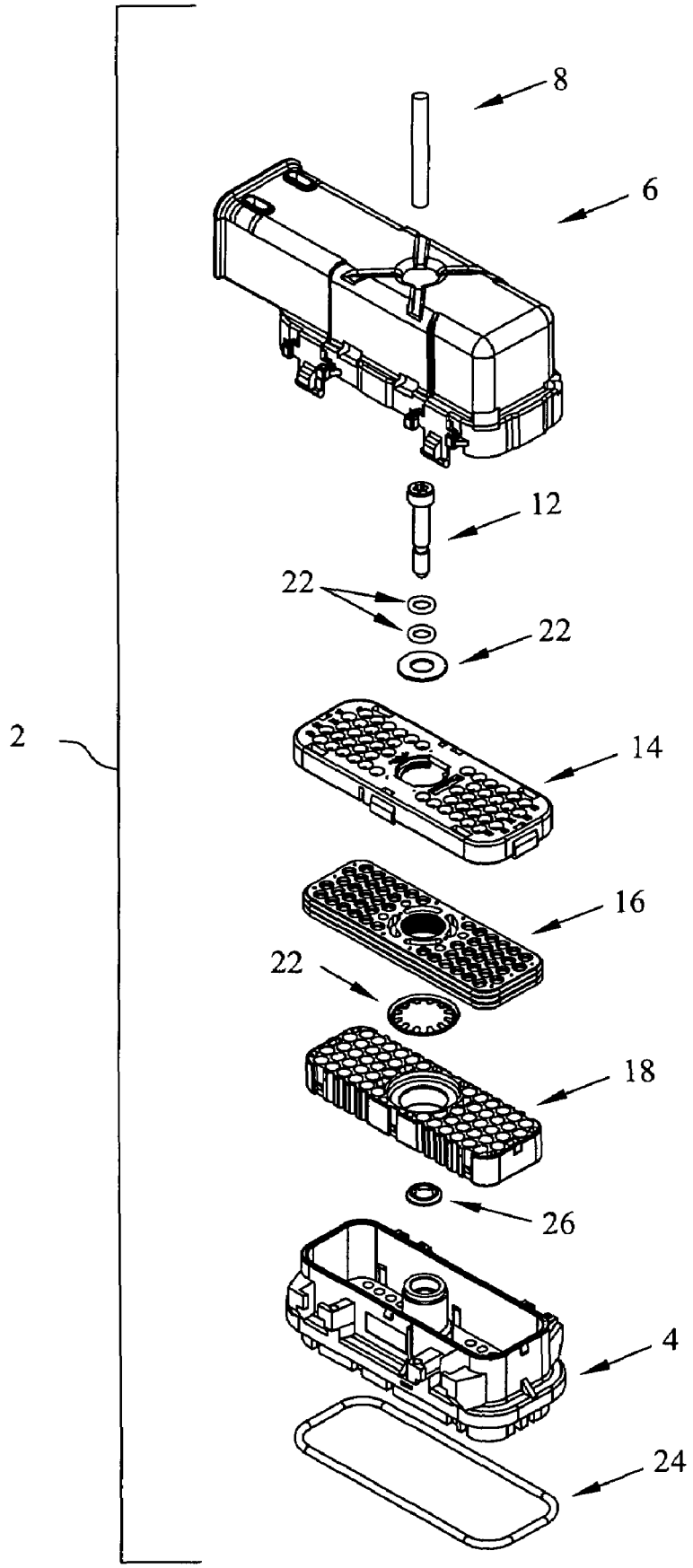
FIG. 2 shows an exploded view of the connector assembly of FIG. 1.

With respect first to FIG. 1, an electrical connector assembly 2 is shown having a plug housing 4, a wire dress cover 6, and a locking insert 8, and an elongate tensioned member shown here as a serialized lock-wire 10, fixedly retained to the wire dress cover. It should be appreciated that the electrical connector assembly 2 is the type which could be connected to a mating device, which could be an electronic control unit (ECU) in an equipment application such as an automotive, construction vehicle, or any industrial/commercial/consumer equipment that requires tamper restrictions. With reference now to FIG. 2, the electrical connector assembly 2 is shown in an exploded view and which further comprises an attachment mechanism 12 in the form of a jack screw, a seal cover 14, a mat seal 16 and a contact retention insert 18. Such items as O-rings 20, fastening items such as washers 22, O-ring 24, and retaining nut 26 may also be included.

Figure 3:
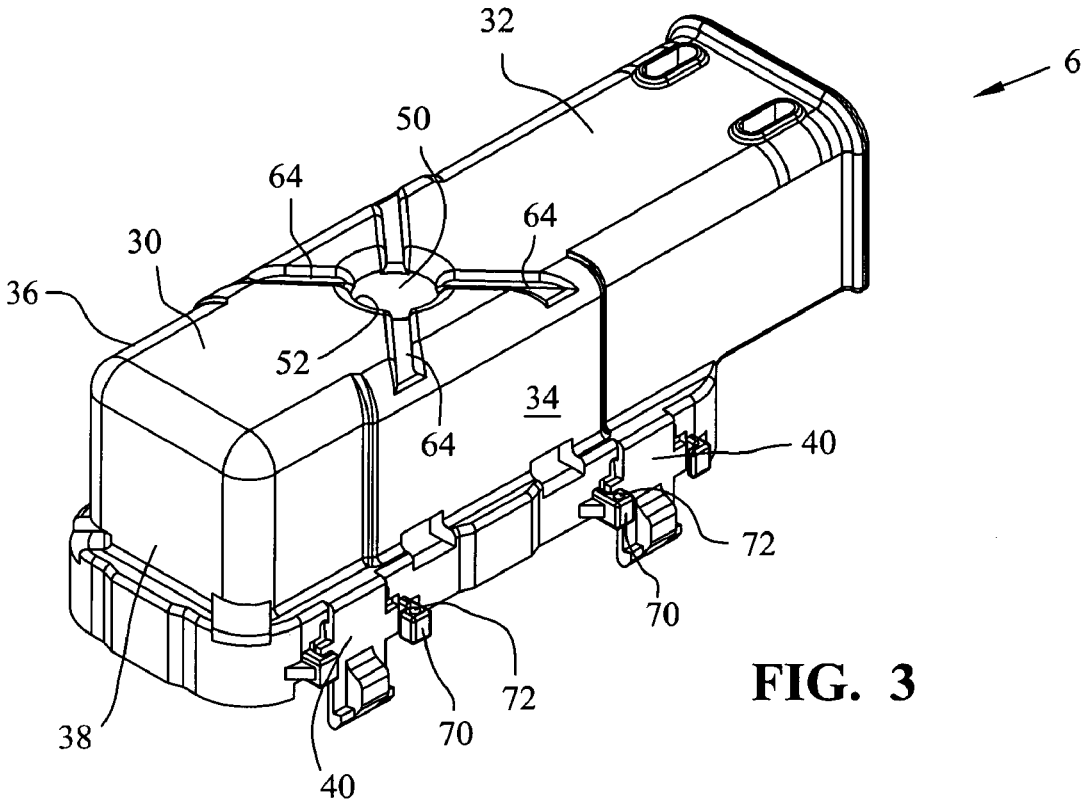
FIG. 3 shows a top perspective view of the wire dress cover of FIG. 1.
Figure 4:
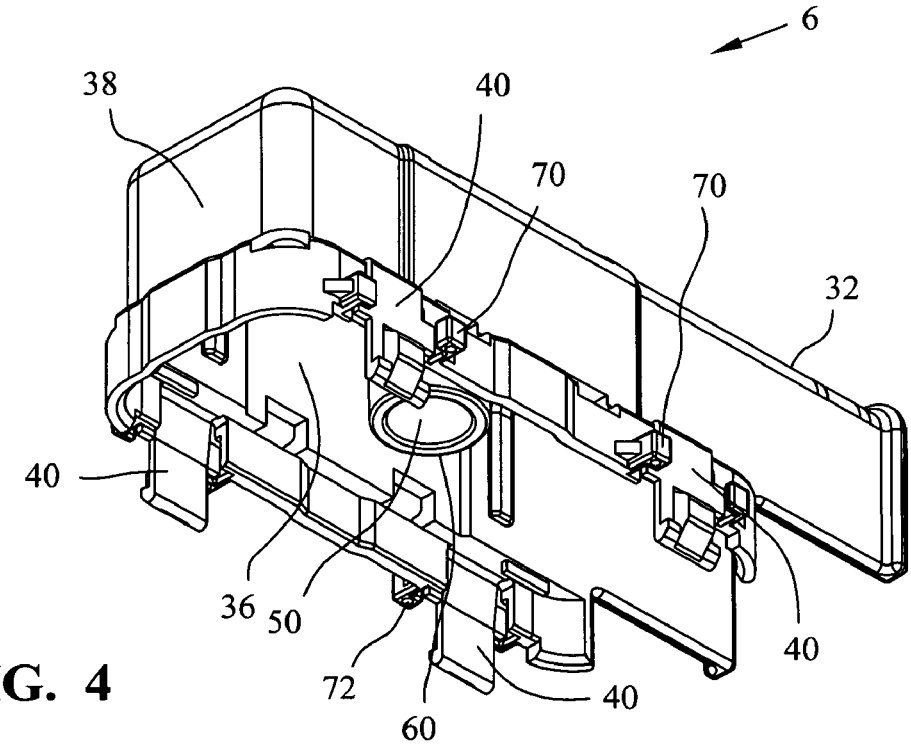
FIG. 4 shows a bottom perspective view of the wire dress cover of FIG. 3.

With reference now to FIGS. 3 and 4, the wire dress cover 6 will be described in greater detail. The wire dress cover 6 is comprised of a top wall 30 having a wire dress shroud at 32. Wire dress cover 6 further includes side walls 34, 36 and end wall 38 where each of the side walls 34, 36 includes latches 40 extending downwardly. Wire dress cover 6 also includes an access opening 50 having an inner cylindrical wall 52 as best shown in FIG. 3. A post 60 extends downwardly from top wall 30 as best shown in FIG. 4. As best shown in FIG. 3, wire dress cover 6 includes a lock-wire channel 64, which as shown in FIG. 3, is cruciform in configuration. Finally, wire dress cover 6 includes lock-wire tabs 70 having through-holes 72, as described more fully herein.

Figure 5:
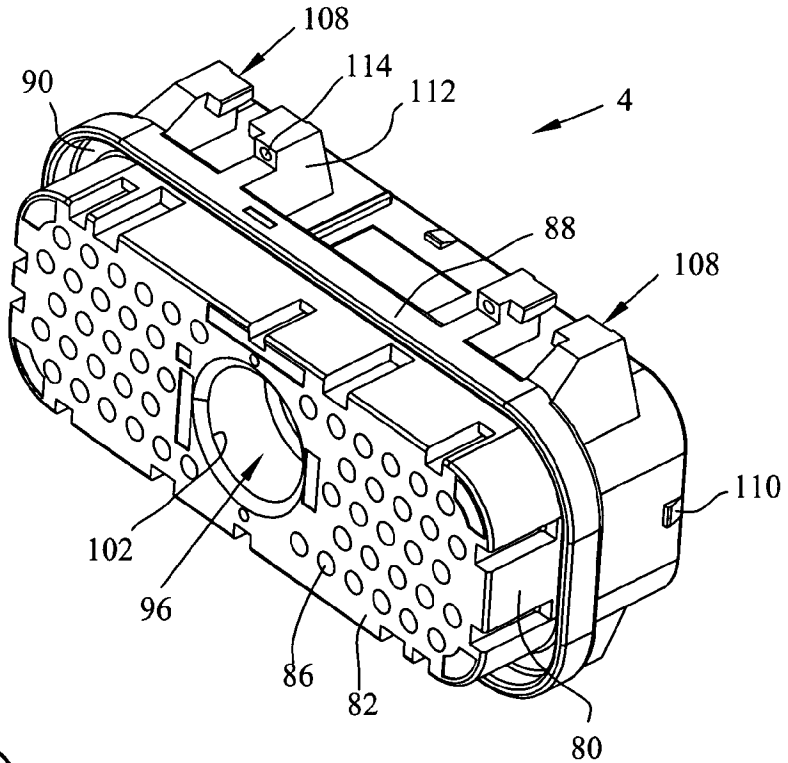
FIGS. 5 and 6 show opposite side perspective views of the plug housing shown in FIG. 2.
Figure 6:
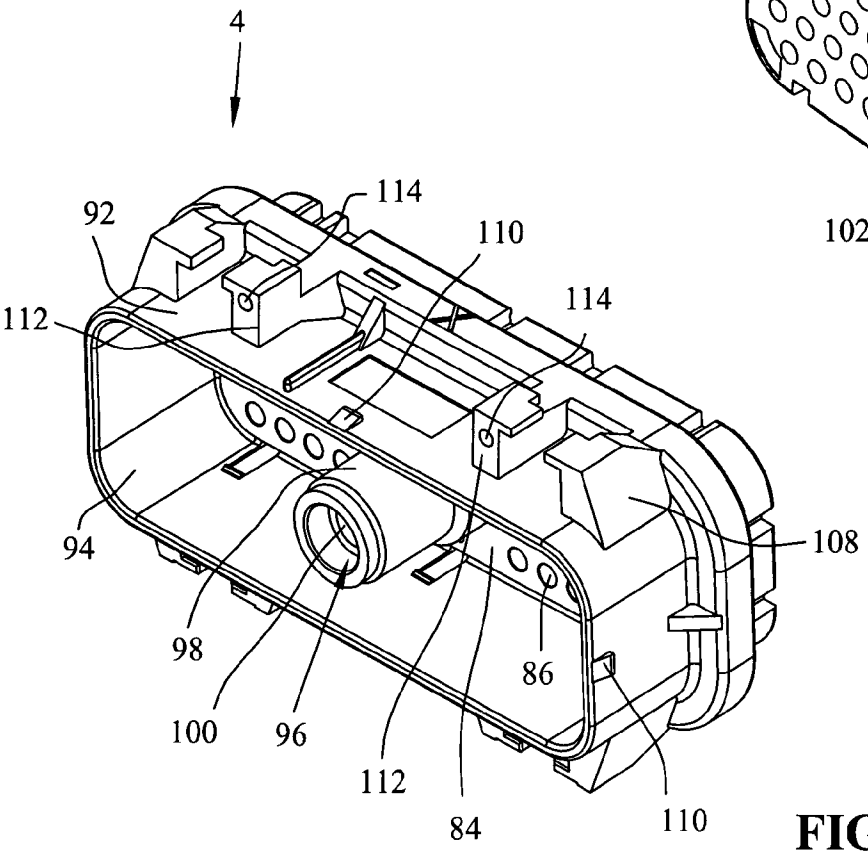

With respect now to FIGS. 5 and 6, the plug housing 4 is shown in greater detail. Plug housing 4 generally includes a housing body portion 80 having a front face 82, a rear face 84 and contact receiving apertures 86 extending therethrough. Plug housing 4 further includes a forwardly facing shroud 88 defining a peripheral inner channel 90, which may receive O-ring 24 FIG. 2), and further includes a rearwardly facing shroud 92 which defines an inner space 94. A through bore 96 is defined by a tubular wall 98 extending from the rear face 84 which has an inner diameter 100 dimensioned to receive the shank of jack screw 12. Inner diameter 100 opens up into an enlarged diameter section 102 (FIG. 5) and may receive the threaded portion of jack screw 12. Plug housing 4 further includes complementary latching members 108 which cooperate with latches 40 on the wire dress cover 6 and includes latches 110 as described further herein. As shown in FIGS. 5 and 6, plug housing 4 further includes wire blocks 112 extending as a portion of the latching members 108, and each include an aperture 114 aligned with through-holes 72 (FIG. 3).

Figure 8:
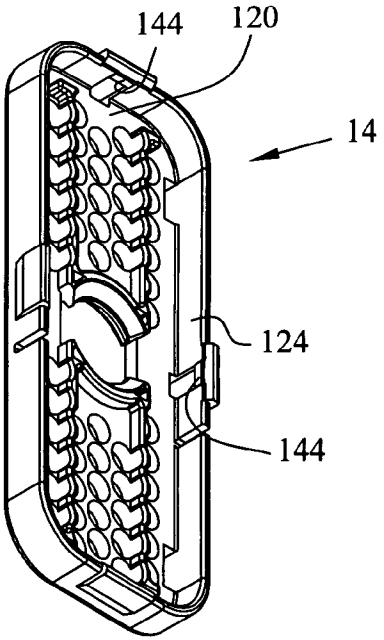
FIG. 8 shows an inside perspective view of the seal cover from the opposite side as that shown in FIG. 7.
Figure 9:
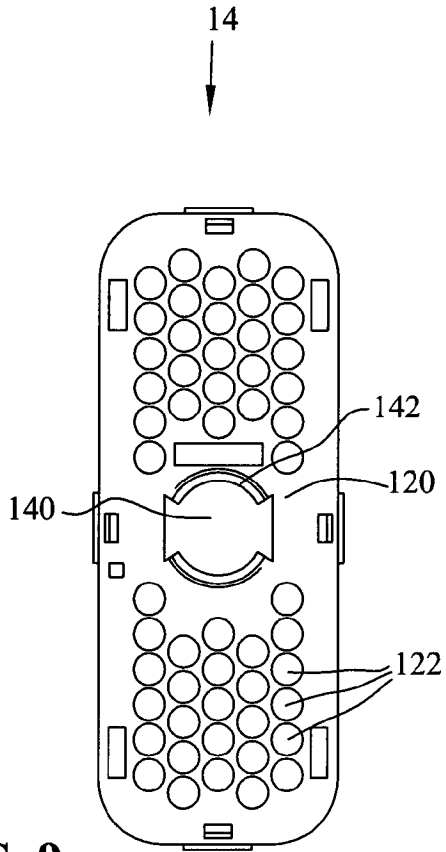
FIG. 9 shows a top plan view of the seal cover shown in FIG. 7.
Figure 7:
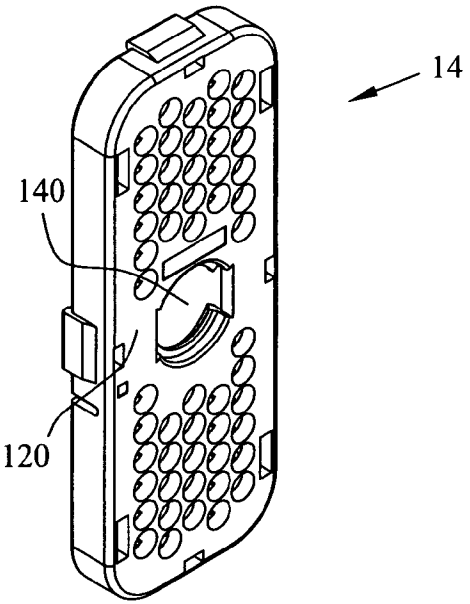
FIG. 7 shows a top perspective view of the seal cover shown in FIG. 2.

With respect to FIGS. 7-9, seal cover 14 will be described in greater detail. Seal cover 14 includes a body portion 120 having a plurality of wire and contact receiving openings 122 extending therethrough and a shroud wall 124 which extends peripherally around the body portion to define a seal receiving area between the body portion 120 and shroud wall 124. Seal cover also include a central opening 140 which is aligned with access opening 50 (FIGS. 3 and 4), and which includes a shoulder 142. Finally, latches 144 (FIG. 8) are provided on an inner surface of wall shroud 124 and cooperate with latches 110 (FIGS. 5 and 6) provided on plug housing 4.

Referring again to FIG. 1, the locking insert 8 is shown which is generally defined as a cylindrical portion, closely toleranced for receipt in access opening 50. With the above described components and elements, the assembly and use of the connector assembly will now be described.

Figure 10:
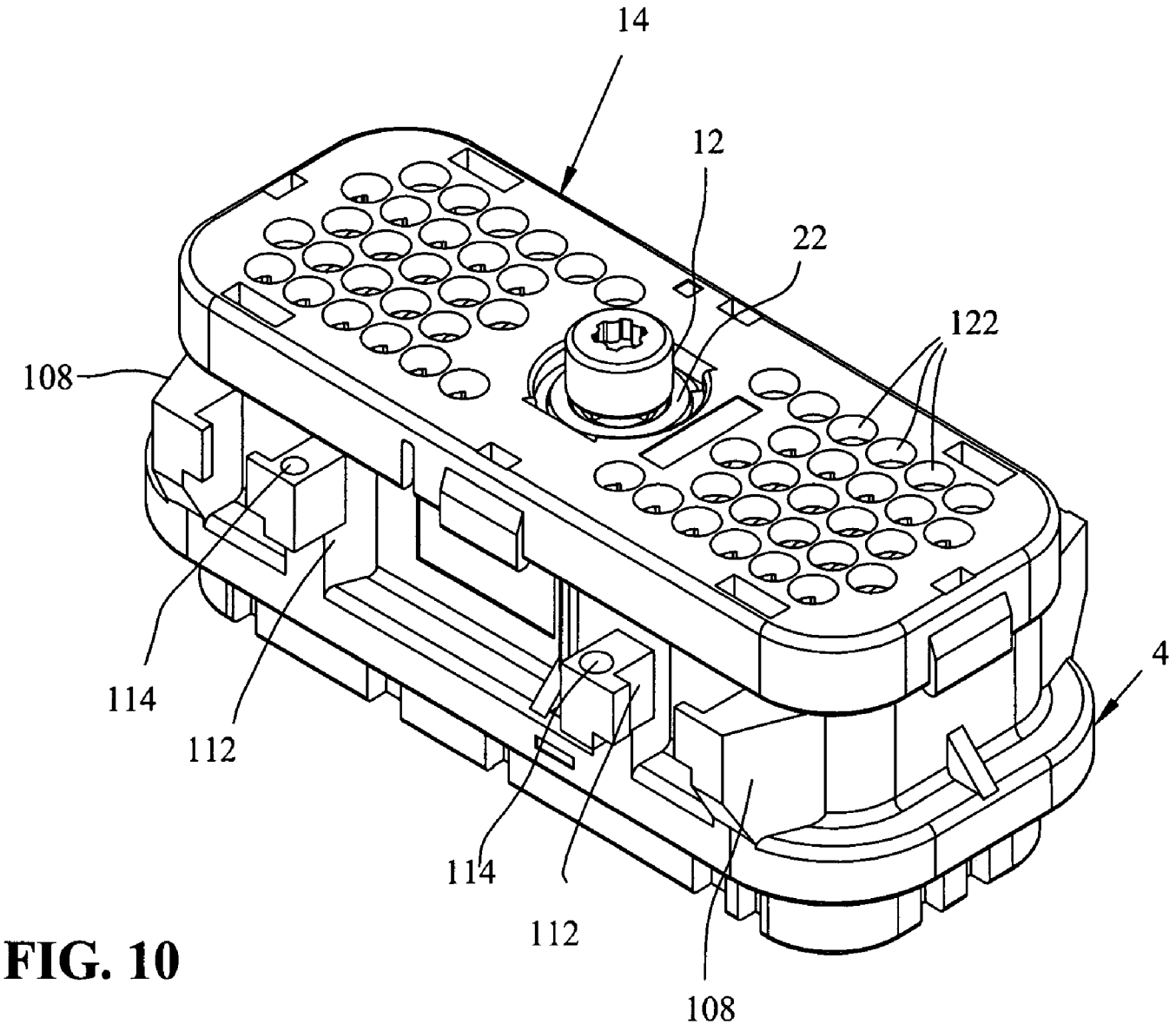
FIG. 10 shows a perspective view of the seal cover and plug housing latched together.

With respect to FIG. 10, a subassembly is provided by placing the O-ring 24 (FIG. 2) in channel 90 (FIG. 5), and by placing retention insert 18 and mat seal 16 (FIG. 2) within the inner space 94 (FIG. 6) defined in the plug housing 4. Seal cover 14 may now be snapped to plug housing 4 as shown in FIG. 10, and jack screw 12 together with washer 22 and O-ring 20 may be positioned in central opening 140, thereby forming a plug housing assembly. As mentioned above, this places the threaded portion of jack screw 12 within the enlarged diameter section 102 (FIG. 5). This also seats washer 22 on shoulder 142 (FIG. 9). At this point, a plurality of contacts terminated to insulated conductors may be positioned through contact receiving apertures 122 of seal cover 14, through mat seal 16, through contact retention insert 18 and finally into and through apertures 86 (FIGS. 5 and 6). As is known in the art, retaining nut 26 may be positioned around the jack screw 12 which retains the jack screw longitudinally within the assembly of the FIG. 10 components, but allows free rotational movement of the jack screw 12.

Figure 11:
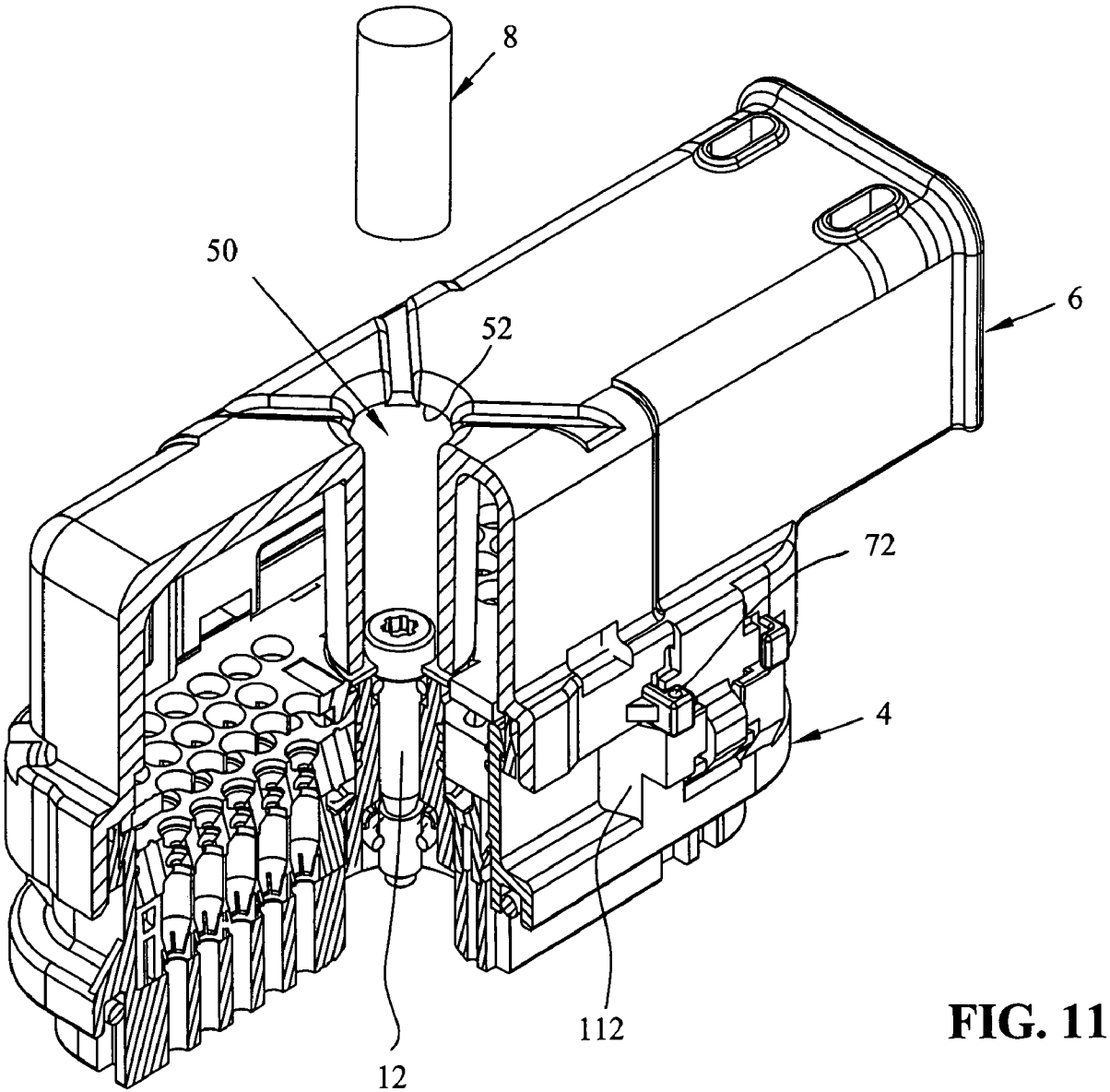
FIG. 11 shows a partial cutaway view of the wire dress cover assembled to the seal cover and plug housing with the locking insert poised for receipt into the wire dress cover.
Figure 12:
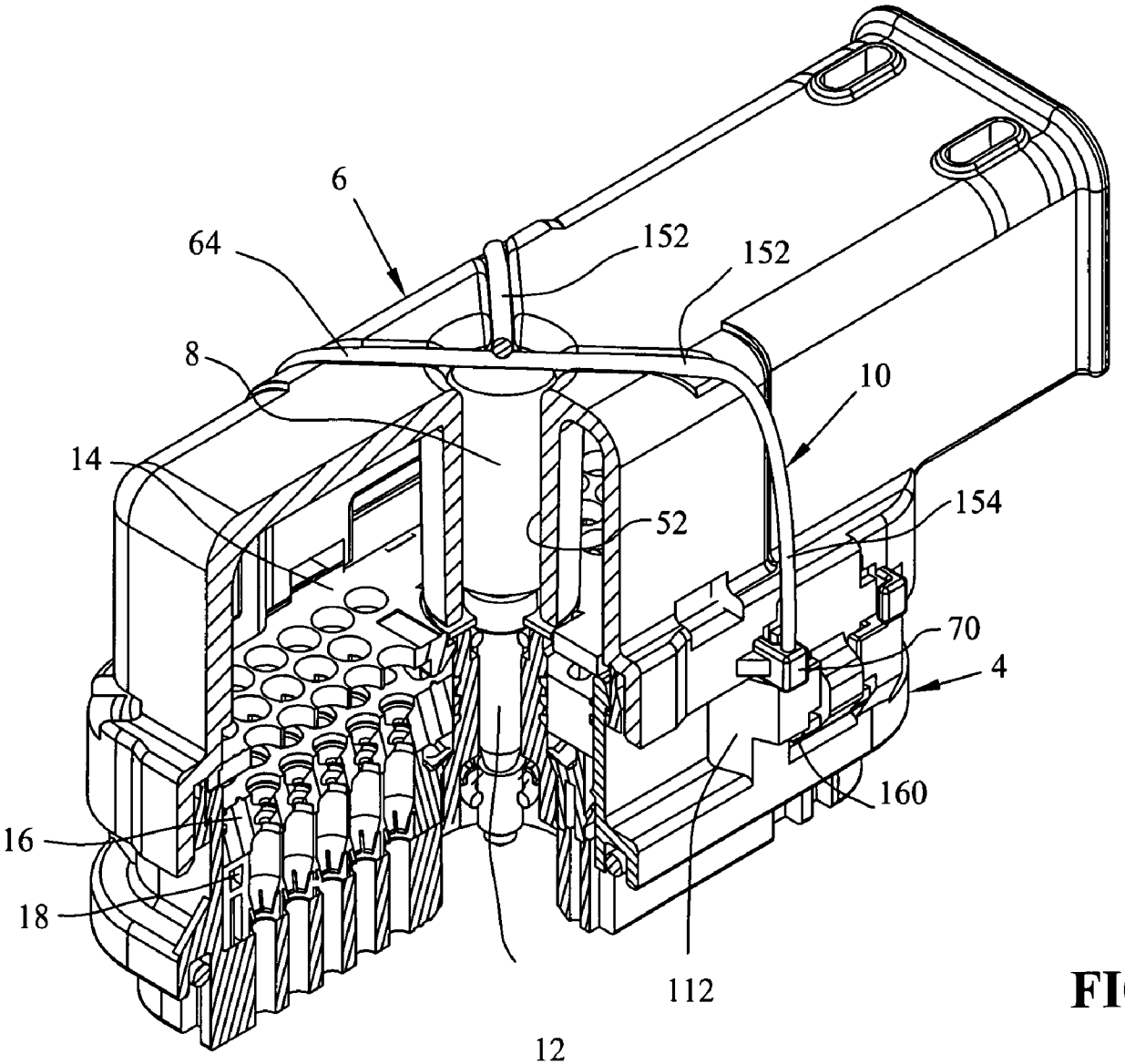
FIG. 12 shows a partial cut away view of the locking insert with the lock-wire positioned over the insert and wire dress cover.

It should be appreciated that wire dress cover 6 may now be positioned over the assembly of FIG. 10 with cooperating latches 40 and latching members 108 retaining the wire dress cover 6 to plug housing 4. As shown in FIG. 11, with the wire dress cover 6 snapped in place to plug housing 4, access opening 50 communicates with the jack screw 12 and with central opening 140 (FIG. 9) of the seal cover 14. Thus, the FIG. 11 configuration may be connected to a mating device with the jack screw connecting the assembly to the mating device. With respect now to FIG. 12, locking insert 8 is shown positioned within access opening 50, and with lock-wire portions 152 of serialized lock-wire 10 positioned within lock-wire grooves 64 and with lock-wire portions 154 aligned with, and drawn through through-holes 72 (FIG. 11) and apertures 114. The end of lock-wire portions 154 are then fixed, for example by way of a crimp member (or weld bead) 160.

It should be appreciated that this design provides evidence of tampering, as the locking insert 8 cannot be removed to reach the jack screw, without removing the serialized wire, which in and of itself evidences tampering. If the wire dress cover 6 is forcibly removed from the plug housing or the connector is "unmated" by turning the jack screw without removing the locking insert 8, there will be also be evidence of tampering.

Figure 13:
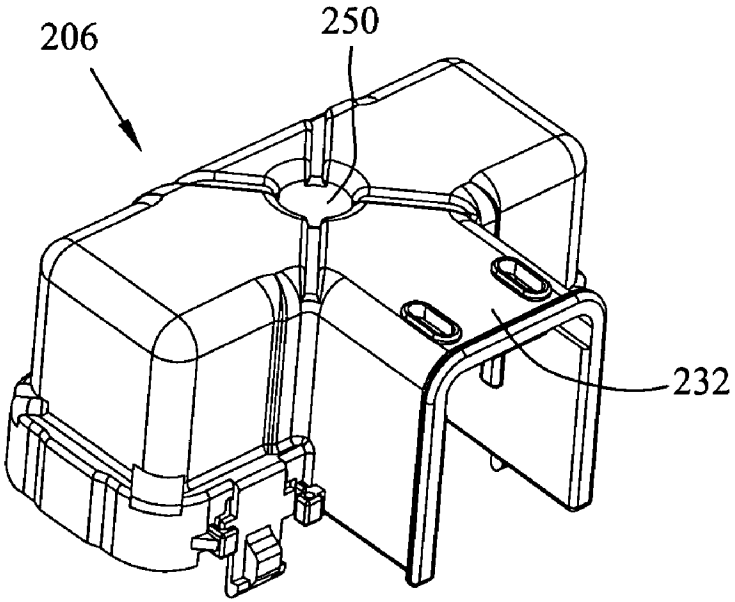
FIGS. 13 and 14 show upper and lower perspective views of an alternate wire dress cover.
Figure 14:
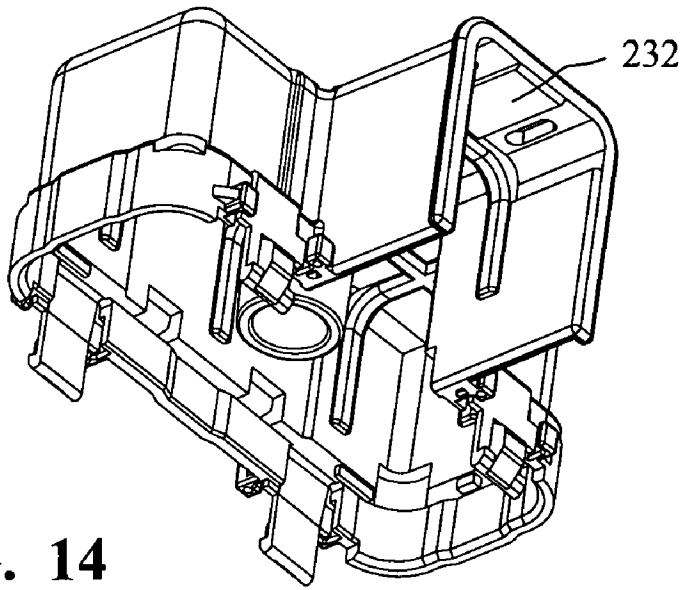

It should be appreciated that numerous different configurations are conceivable using the teachings of the present application. For example, an alternate locking insert could be used, which is shorter in length, and which may also include apertures for receipt of the lock-wire 10. It is also possible that the insert 8 is not required at all, but rather the lock-wire 10 provides adequate security. Elongate tensioned member 10 could also be other forms such as any elastic member which would form a secure tensioning, or could be a tensioned metal band. Furthermore, and with reference to FIGS. 13 and 14, another version of wire dress cover is shown at 206, having a wire dress shroud at 232 and an access opening at 250. Multiple other configurations are possible, without departing from the teachings herein.

What is claimed is:

1. An electrical connector assembly for attachment to a mating device, comprising:

a plug housing assembly;

an attachment mechanism for attaching the plug housing assembly to the mating device;

a wire dress cover attached to the plug housing assembly, with an access opening communicating with the attachment mechanism; and a lock-wire receivable over the access opening and covering the attachment mechanism, and being retainable to the plug housing assembly.

2. An electrical connector assembly of claim 1, wherein the plug housing assembly is comprised of a plug housing and a seal cover.

3. An electrical connector assembly of claim 2, further comprising a mat seal, wherein the seal cover traps the mat seal in place to the plug housing.

4. An electrical connector assembly of claim 2, further comprising a locking insert member positioned within the access opening, and under the lock-wire.

5. An electrical connector assembly of claim 2, further comprising a locking insert member positioned within the access opening, with the lock-wire extending though the insert member.

6. An electrical connector assembly of claim 1, wherein the wire dress cover includes a wire receiving channel formed therein to receive the lock-wire.

7. An electrical connector assembly of claim 6, wherein the wire receiving channel is formed in a cruciform configuration.

8. An electrical connector assembly of claim 7, wherein the cruciform configuration intersects the access opening.

9. An electrical connector assembly of claim 2, wherein the lock-wire is secured to the plug housing.

10. An electrical connector assembly for attachment to a mating device, comprising:

a plug housing assembly;

an attachment mechanism for attaching the plug housing assembly to the mating device;

a wire dress cover attached to the plug housing assembly, with an access opening communicating with the attachment mechanism;

a locking insert member at least partially covering the access opening; and an elongate tensioned member attached to the plug housing assembly and retaining the insert member over the access opening.

11. An electrical connector assembly of claim 10, wherein the plug housing assembly is comprised of a plug housing and a seal cover.

12. An electrical connector assembly of claim 11, further comprising a mat seal, wherein the seal cover traps the mat seal in place to the plug housing.

13. An electrical connector assembly of claim 10, wherein the insert member is positioned within the access opening, and under the elongate tensioned member.

14. An electrical connector assembly of claim 10, wherein the insert member is positioned within the access opening, with the elongate tensioned member extending though the insert member.

15. An electrical connector assembly of claim 10, wherein the wire dress cover includes a receiving channel formed therein to receive the elongate tensioned member.

16. An electrical connector assembly of claim 15, wherein the receiving channel is formed in a cruciform configuration.

17. An electrical connector assembly of claim 16, wherein the cruciform configuration intersects the access opening.

18. An electrical connector assembly of claim 17, wherein the elongate tensioned member is secured to the plug housing.

19. An electrical connector assembly of claim 18, wherein the elongate tensioned member is a lock-wire.

20. An electrical connector assembly of claim 10, wherein the elongate tensioned member is a lock-wire.

* * * * *